US005672320A

United States Patent [19]

Ritter

[11] Patent Number: 5,672,320

[45] Date of Patent: Sep. 30, 1997

[54] REPEATING PIPET HAVING A PLUNGER ADVANCE MECHANISM

[76] Inventor: Ralf Ritter, Schwabenstrasse 54, 86836 Untermeitingen, Germany

[21] Appl. No.: 537,505

[22] Filed: Oct. 2, 1995

[30] Foreign Application Priority Data

Sep. 30, 1994 [DE] Germany ..... 9415847 U

[51] Int. Cl.[6] ..... B01L 3/02

[52] U.S. Cl. ..... 422/100; 73/864.16; 73/864.18; 222/287

[58] Field of Search ..... 422/100, 101, 422/102, 103, 104; 73/864.16, 864.18; 436/180; 222/287, 309, 321

[56] References Cited

U.S. PATENT DOCUMENTS

| | | | |
|---|---|---|---|
| 4,099,548 | 7/1978 | Sturm et al. | 141/27 |
| 4,399,711 | 8/1983 | Klein | 73/864.16 |
| 4,406,170 | 9/1983 | Kuhn | 73/864.16 |
| 5,323,931 | 6/1994 | Robards, Jr. et al. | 222/96 |

FOREIGN PATENT DOCUMENTS

| | | |
|---|---|---|
| 29 26 691 | 5/1983 | Germany . |
| 32 16 644 | 2/1990 | Germany . |

*Primary Examiner*—Harold Pyon
*Attorney, Agent, or Firm*—Oliff & Berridge

[57] ABSTRACT

An advancing mechanism is provided for movement of a pipet plunger in a repeating pipet. The advancing mechanism includes a rack communicating with the pipet plunger, a pawl pretensioned against the rack and displaceable by an activating element and an engagement control element located between the rack and the pawl. The advancing mechanism also includes an adjusting element for adjusting the engagement control element to one of a plurality of engagement positions. The engagement control element is preferably a rotatable sleeve having lower axial steps and upper limiting stops. The pawl is connected to a sliding body connected with the actuating element and axially displaceable within the sleeve.

13 Claims, 2 Drawing Sheets

REPEATING PIPET HAVING A PLUNGER ADVANCE MECHANISM

BACKGROUND OF THE INVENTION

1. Field of the Invention

The invention relates to a repeating pipet having a plunger advance mechanism for stepwise forward movement of a pipet plunger.

2. Description of Related Art

Conventional repeating pipets are used to repeatedly dispense small volumes of liquid by stepwise advancement of a plunger in a plunger pipet with high dispensing accuracy. The quantity of liquid dispensed per plunger step is adjustable between a maximum and a minimum.

One type of conventional repeating pipet is disclosed in DE-OS 29 26 691, the subject matter of which is incorporated herein by reference. In this pipet, the pawl of the plunger advance mechanism is a manually operated pivoting lever that pivots downward from an upper end position by a fixed distance each time. An engagement control element consists of an elongated cover plate located between the rack and the pawl. The plate is advanced by an adjusting element in the path of travel of the pawl. The rack and cover plate are formed by elements cooperating with one another such that toward the end of the possible total displacement travel of the pipet plunger, the cover plate is lifted from the rack until engagement can no longer occur between the pawl and the rack in order to avoid a residual step taking place whose volume is not defined but which still corresponds to a portion of a complete plunger stroke step.

Although this ensures that no incomplete residual steps can be performed, it is unsatisfactory that a residual volume remains in the pipet corresponding to a full plunger step that can be rather large.

Another conventional repeating pipet is disclosed in DE-OS 32 16 644, the subject matter of which is incorporated herein by reference. In this pipet, the plunger step value is not controlled by an adjustable engagement control element between the rack and the pawl. Rather, the step value is controlled by an adjustable stop mounted on the actuating element that limits the travel of the actuating element. A fixed element is located between the pawl and the rack that lifts the pawl from the rack at the end of the return travel of the actuating element. When the actuating element is operated, the pawl engages the rack only after a certain initial phase of travel of the actuating element. The actuating element is designed as a sliding body displaceable in the plunger advance direction in which a stop sleeve is rotatably incorporated but axially nondisplaceably. The sleeve is provided at its lower end with a row of steps that follow one another in staircase fashion in the circumferential direction. The steps cooperate with a fixed limiting stop depending on the setting of the stop sleeve.

Thus, in this conventional repeating pipet, travel of the actuating element is dependent on the pawl travel. The travel of the actuating element changes with the setting of the respective pawl travel. The main disadvantage of this known repeating pipet is that at the end of the possible plunger advance travel, an incomplete residual advance step remains with a correspondingly undefined dispensing volume of liquid. No action is taken to correct the problem of such incomplete residual steps. Since the operator may not necessarily notice the deficiency of an incomplete residual step, there is the risk that unsatisfactory work can be performed relatively frequently. This could result in improperly dispensed liquid samples and distorted laboratory results.

SUMMARY OF THE INVENTION

It is an object of the present invention to provide a repeating pipet that does not suffer from any of the disadvantages of conventional repeating pipets. That is, it is an object to provide a pipet that does not allow an incomplete residual step in the plunger advance and a pipet designed so no significant unused residual volume of liquid can remain.

This invention therefore provides an advancing mechanism for movement of a pipet plunger in a repeating pipet. The advancing mechanism includes a rack communicating with the pipet plunger, a pawl pretensioned against the rack and displaceable by an activating element and an engagement control element located between the rack and the pawl. The advancing mechanism also includes an adjusting element for adjusting the engagement control element to one of a plurality of engagement positions. The engagement control element is preferably a rotatable sleeve having lower axial steps and upper limiting stops. The pawl is connected to a sliding body connected with the actuating element and axially displaceable with the sleeve.

In the repeating pipet, each setting (i.e., every travel step size adjustment) of the engagement control element is associated with a corresponding rack stop that limits the upward travel when the plunger is retracted such that the possible piston advance travel when the pipet is emptied is an exact multiple of the plunger advance step size. The device would preferably be dimensioned so the upward travel of the plunger corresponds to a multiple of the advance step size plus a constant small safety distance (e.g., half a millimeter). When the plunger is fully advanced, it is still separated from the end of the pipet by this safety distance in order to take into account tolerances in the plunger pipets and their plungers. In any event, only a minimum negligible residual volume remains in the pipet.

Other objects, advantages and salient features of the invention will become apparent from the following detailed description taken in conjunction with the annexed drawings, which disclose preferred embodiments of the invention.

BRIEF DESCRIPTION OF THE DRAWINGS

The invention will be described in detail with reference to the attached drawings in which like reference numerals refer to like elements and wherein.

DETAILED DESCRIPTION OF PREFERRED EMBODIMENTS

Figure 1:
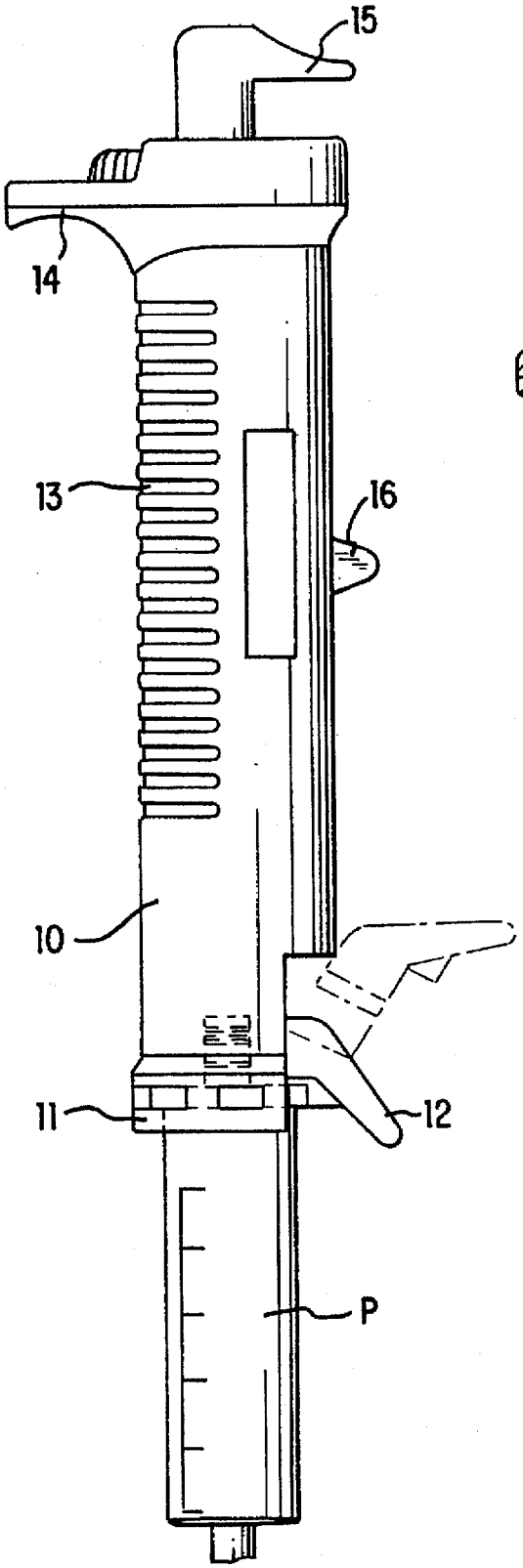
FIG. 1 is a side view of the repeating pipet.

FIG. 1 shows an external side view of a repeating pipet according to the present invention. The pipet has a housing 10 with a receptacle 11 on the bottom having a locking lever 12 to receive and hold a plunger pipet P. The pipet also has a gripped profile 13 and a finger stop 14 in the upper area. An actuating element 15 of the plunger advance mechanism projects from the top of housing 10. A retracting lever 16 is connected with a rack 21 of the plunger advance mechanism and projects from a slot 17 on the right side of the housing 10 to pull the plunger pipet P.

Figure 2:
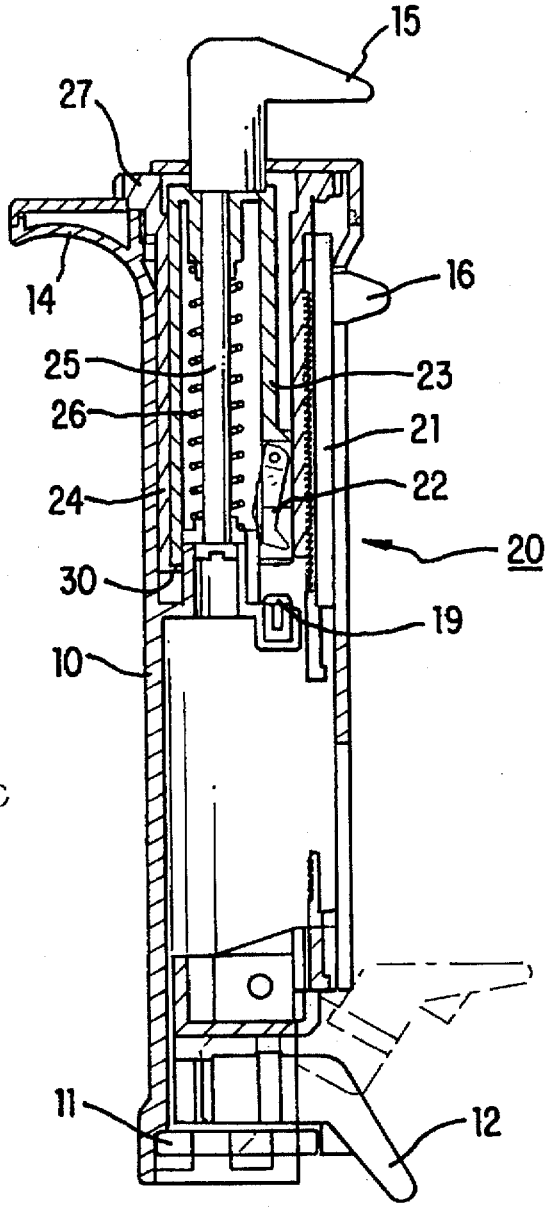
FIG. 2 is a lengthwise view of the repeating pipet.

The inner construction of the repeating pipet can be seen in the lengthwise section shown in FIG. 2. As discussed above, the lower end area of housing 10 has receptacle 11 for receiving a plunger pipet P (not shown in FIG. 2). The locking lever 12 holds the pipet P in place. The locking lever 12 is shown in FIG. 2 in its locked position while the dashed lines show the lever 12 in its released position. Receptacle 11 is shown only schematically.

The following description will be of the plunger advance mechanism located in an upper part of one housing 10.

The plunger advance mechanism 20 has a rack 21 displaceably guided in housing 10. The rack 21 has its lower end coupled with a coupling element that engages the upper end of the pipet plunger P. A retracting lever 16 is mounted on rack 21 in the form of a nose projecting through the slot 17 in the housing 10.

The plunger advance mechanism 20 also has a pawl 22 that pivots radially outward in a lower end of a sliding body 23. The grip 15 is fastened to an upper end of the sliding body 23. The sliding body 23 is displaceably guided inside a sleeve 24. The rack 21 extends outside the sleeve 24 while remaining parallel (i.e., along a jacket line of sleeve 24).

The sliding body 23 has a rod 25 fastened thereto and running concentric (axially parallel) with respect to the axis of the sleeve 24. The rod 25 is preferably in the form of a screw. The rod 25 is fastened to the grip 15 and is displaceable in a guide sleeve 18 integral with the housing 10. The head of the rod 25 acts in cooperation with a shoulder of the guide sleeve 18 as a stop to set an upper end position of the sliding body 23. A coil compression spring 26 is installed between an upper spring seat formed on the guide sleeve 18 and a lower spring seat formed on the sliding body 23. The spring 26 pretensions the sliding body 23 in an upper resting position.

Figure 3:
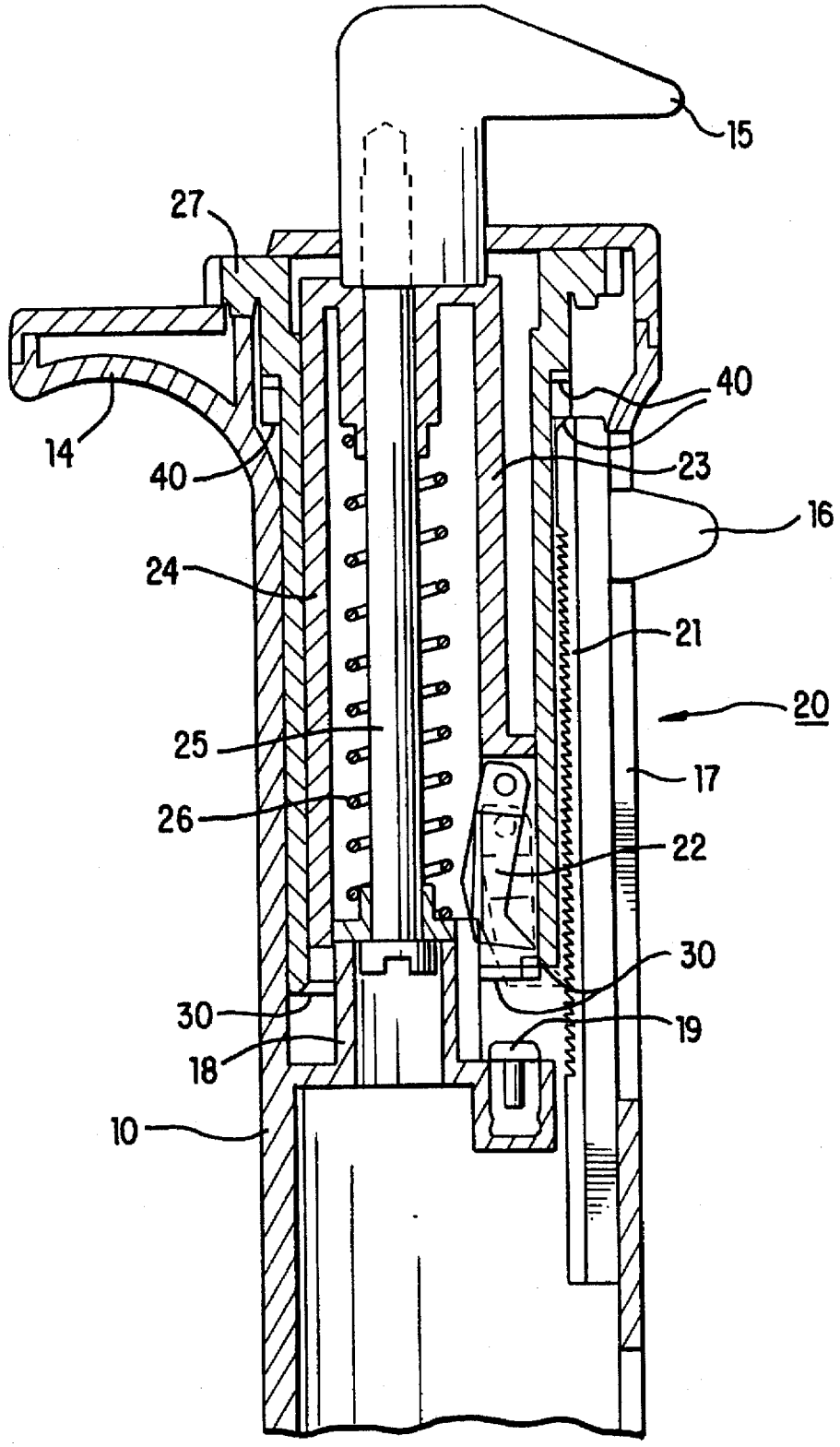
FIG. 3 is an enlarged axial section showing an upper part of the repeating pipet containing the plunger advance mechanism.

Pawl 22 is located inside sleeve 24 and is shown in FIGS. 2 and 3 disengaged from rack 21. When the sliding body 23 is urged downward by pressing down on grip 15 (against the force of return spring 26), the pawl 22 engages rack 21 when its engaging nose emerges beyond the lower end of sleeve 24 since pawl 22 is pretensioned toward the rack by a spring (not shown). During the subsequent downward movement of the sliding body 23, the pawl 22 engages rack 21 and thus displaces the pipet plunger P until the displacement of sliding body 23 and the pawl 22 ends by a stop 19 integral with the housing 10.

The sleeve 24 is mounted axially and rotatably in housing 10 and is connected integrally at the top with an adjusting ring 27 knurled at its circumference. The adjusting ring 27 is accessible, for example, by a finger stop 14 through a corresponding opening in the housing 10. The rotatable sleeve 24 is provided at its lower end with a plurality of steps 30 that follow one another stepwise in the circumferential direction. The steps 30 are positionable optionally above rack 21 by rotating the sleeve 24 using the adjusting ring 27. The adjusting ring 27 is advantageously provided with a scale for this purpose and the upper end of the housing 10 preferably includes corresponding reference markings.

Depending on which step 30 of the lower end of rotatable sleeve 24 is set above the rack 21, the lower end of sleeve 24 overlaps the rack 21 in a direction of the pawl travel so the pawl 22 comes into engagement with the rack 21 to thereby produce an advance step of the pipet plunger P.

In addition, the rotatable sleeve 24 includes a plurality of limiting stops 40 on an upper and outer circumference area for the retracting motion of rack 21 when the pipet plunger P is raised.

These limiting stops 40 are in the form of end areas following one another in the circumferential direction on an outer annular shoulder formed in the upper sleeve area. The limiting stops 40 are also preferably axially staggered in the circumferential direction.

Each lower step 30 of sleeve 24 is associated with an upper outer limiting stop 40. The individual upper limiting stops 40 are axially positioned such that for a given setting of the plunger advance step size for the corresponding lower step 30, the pipet plunger retraction travel corresponds to a whole-number multiple of the plunger advance step size (plus a fixed small safety distance between the pipet plunger P and the lower pipet end in the lowermost plunger position to compensate for tolerances).

For example, if rack 21 is made with 49 teeth and the lower end of sleeve 24 has five steps 30 so designed that five selectable step sizes corresponding to 1, 2, 3, 4, and 5 tooth divisions, the upper steps 40 are designed so in the position with a step size of 1 tooth division, a piston retraction travel corresponding to 49 tooth divisions (producing 49 strokes per tooth division) is set. In a position with a step size of 2 tooth divisions, a piston retraction travel corresponding to 48 tooth divisions (producing 24 strokes for each 2 tooth divisions) is set. In a position with a step size of 3 tooth divisions, a piston retraction travel of 48 tooth divisions (16 strokes for each 3 tooth divisions) is set. In the position with a step size of 4 tooth divisions, a piston retraction travel corresponding to 48 tooth divisions (12 strokes per 4 tooth divisions) is set. In the position with a step size of 5 tooth divisions, a piston retraction travel of 45 tooth divisions (9 strokes for every 5 tooth divisions) is set. In each case the above-mentioned fixed safety distance of half a millimeter is also present, for example. Thus, when the pipet is emptied, there is always a whole number of complete plunger travel steps and the rack always reaches the same lower end position after the last step and the same small residual volume of liquid always remains in the pipet (corresponding to the small safety distance of 0.5 mm for example between the pipet plunger and the pipet end wall in the lowermost position).

While the invention has been described with reference to specific embodiments, the description of the specific embodiments is illustrative only and is not to be construed as limiting the scope of the invention. Various other modifications and changes may occur to those skilled in the art without departing from the spirit and scope of the invention.

What is claimed is:

1. An advancing mechanism for movement of a pipet plunger in a repeating pipet having a receptacle receiving an upper end of the plunger pipet, the advancing mechanism comprising:

a rack communicating with the pipet plunger and a return lever for pulling the pipet plunger backward;

a pawl pretensioned against the rack into an initial position;

an engagement control element located between the rack and the pawl, the engagement control element permitting engagement of the pawl with the rack only during a certain portion of a pawl advance travel, the engagement control element keeping the pawl out of engagement with the rack during a remainder of the pawl advance travel;

an adjusting element for adjusting the engagement control element to one of a plurality of engagement positions, each engagement position setting a plunger step length for each stroke of the pawl, the engagement control element being a rotatable sleeve having a lower end provided with a plurality of lower axial steps that control engagement between the pawl and said rack, said rack mounted outside the rotatable sleeve and having teeth facing the sleeve, said pawl being connected to a sliding body connected with an actuating element and axially displaceable with the sleeve, the rotatable sleeve having a plurality of limiting stops at an upper circumference that correspond to the plurality of lower axial steps, each limiting stop associated with one of the lower axial steps and with a corresponding setting of the engagement control element to set a retraction motion travel of the rack and the plunger to a whole-number multiple of the respective plunger step length with an additional safety margin and wherein the sliding body is telescopically guided in the rotatable sleeve and the sliding body is pretensioned by a spring into an initial position.

2. The advancing mechanism of claim 1, wherein the limiting stops are formed by an axially stepped outer annular shoulder of the rotatable sleeve.

3. The advancing mechanism of claim 1, wherein the sliding body is displaceably guided in the rotatable sleeve by a rod located parallel to an axis of the rotatable sleeve and a guide bushing cooperating therewith.

4. The advancing mechanism of claim 3, wherein the rod is formed by the shaft of a screw, said screw being displaceable in the guide bushing integral with the housing, the head of said screw cooperating with a shoulder of the guide bushing as a limiting stop for the retraction movement of the sliding body together with the actuating element.

5. The advancing mechanism of claim 1, further comprising a stop cooperating with a forward end of the pawl to limit the pawl travel in the pawl advance direction.

6. An advancing mechanism for movement of a pipet plunger repeating pipet, the advancing mechanism comprising:

a rack connected with the pipet plunger;

a rotatable sleeve having a lower end provided with a plurality of lower axial steps and a plurality of limiting stops on an upper circumference;

a sliding body axially displaceable within the sleeve;

a pawl connected to the sliding body, said pawl being pretensioned against the rack, wherein the rotatable sleeve permits engagement of the pawl with the rack only during certain portions of a pawl travel, the rotatable sleeve prohibiting engagement of the pawl with the rack during other portions of the pawl travel;

an adjusting element adjusting the rotatable sleeve to one of a plurality of engagement positions, wherein each one of the limiting stops is associated with one of the lower axial steps to set a retraction motion of the rack and the pipet plunger to a whole-number multiple of a plunger step length set by the engagement position plus an additional safety margin and wherein the sliding body is telescopically guided in the rotatable sleeve and the sliding body is pretensioned by a spring into an initial position.

7. The advancing mechanism of claim 6, wherein the pawl is displaceable by an actuating element pretensional with a spring.

8. The advancing mechanism of claim 6, wherein each engagement position sets a plunger step length to be performed for each stroke of the pawl.

9. The advancing mechanism of claim 6, wherein the rack is mounted outside the rotatable sleeve and includes teeth facing the sleeve.

10. The advancing mechanism of claim 6, wherein the limiting stops are formed by an axially stepped outer annular shoulder of the rotatable sleeve.

11. The advancing mechanism of claim 6, wherein the sliding body is displaceably guided in the rotatable sleeve by a rod located parallel to an axis of the rotatable sleeve and a guide bushing cooperating therewith.

12. The advancing mechanism of claim 11, wherein the rod is formed by the shaft of a screw, said screw being displaceable in the guide bushing integral with the housing, the head of said screw cooperating with a shoulder of the guide bushing as a retraction stop for the retraction movement of the sliding body together with the actuating element.

13. The advancing mechanism of claim 6, further comprising a stop cooperating with a forward end of the pawl to limit the pawl travel in a pawl advance direction.

* * * * *